US009385423B2

(12) United States Patent
Boutigny et al.

(10) Patent No.: US 9,385,423 B2
(45) Date of Patent: Jul. 5, 2016

(54) PROTECTIVE BALLISTIC RADOME FOR A SATELLITE ANTENNA

(75) Inventors: Pierre-Henry Boutigny, Gennevilliers (FR); Olivier Guingand, Gennevilliers (FR); Laurent Beguet, Gennevilliers (FR)

(73) Assignee: THALES, Courbevoie (FR)

( * ) Notice: Subject to any disclaimer, the term of this patent is extended or adjusted under 35 U.S.C. 154(b) by 386 days.

(21) Appl. No.: 13/992,206

(22) PCT Filed: Dec. 6, 2011

(86) PCT No.: PCT/EP2011/071969

§ 371 (c)(1),
(2), (4) Date: Sep. 27, 2013

(87) PCT Pub. No.: WO2012/076549

PCT Pub. Date: Jun. 14, 2012

(65) Prior Publication Data

US 2014/0292612 A1 Oct. 2, 2014

(30) Foreign Application Priority Data

Dec. 7, 2010 (FR) ..... 10 04767

(51) Int. Cl.
*H01Q 1/42* (2006.01)
*H01Q 3/08* (2006.01)
*H01Q 1/32* (2006.01)

(52) U.S. Cl.
CPC . *H01Q 1/42* (2013.01); *H01Q 1/32* (2013.01); *H01Q 1/422* (2013.01); *H01Q 3/08* (2013.01)

(58) Field of Classification Search
CPC ..... H01Q 1/42; H01Q 1/40; H01Q 1/422; H01Q 1/425
USPC ..... 343/872, 878
See application file for complete search history.

(56) References Cited

U.S. PATENT DOCUMENTS

| | | | | |
|---|---|---|---|---|
| 2,731,055 | A | 1/1956 | Smith | |
| 2003/0220041 | A1* | 11/2003 | Elkouh | B32B 1/00 442/394 |
| 2005/0030250 | A1* | 2/2005 | Gottl | H01Q 1/42 343/878 |
| 2010/0039346 | A1* | 2/2010 | Peter | H01Q 1/40 343/872 |
| 2010/0045544 | A1* | 2/2010 | Maurel | G01S 7/03 343/705 |

FOREIGN PATENT DOCUMENTS

| | | | |
|---|---|---|---|
| DE | 202005009462 | U1 | 12/2005 |
| WO | 2005/062419 | A1 | 7/2005 |
| WO | 2010/076336 | A1 | 7/2010 |

* cited by examiner

*Primary Examiner* — Dameon E Levi
*Assistant Examiner* — Collin Dawkins
(74) *Attorney, Agent, or Firm* — Baker & Hostetler LLP

(57) ABSTRACT

A protective ballistic radome for a satellite antenna which can turn about an axis of rotation, has: a circular support in the form of a ring, having an axis of revolution RR'to coincide with the axis of rotation, with the circular support having a lower base and an upper part in planes respectively parallel and perpendicular to the axis RR', an annular groove, having an axis of revolution that coincides with the axis RR', opening onto the upper part of the circular support, a set of n contiguous walls having upper ends and lower ends in planes that are respectively parallel and perpendicular to the axis RR', the walls having their lower ends inserted into the annular groove of the circular support in order to form a ballistic wall in the form of a tube of circular section, having the same axis of revolution RR', about said satellite antenna.

7 Claims, 5 Drawing Sheets

PROTECTIVE BALLISTIC RADOME FOR A SATELLITE ANTENNA

CROSS-REFERENCE TO RELATED APPLICATIONS

This application is a National Stage of International patent application PCT/EP2011/071969, filed on Dec. 6, 2011, which claims priority to foreign French patent application No. FR 1004767, filed on Dec. 7, 2010, the disclosures of which are incorporated by reference in their entirety.

FIELD OF THE INVENTION

The invention relates to radomes for antennas and notably to a telecommunications antenna radome for mobile satellite links having a high level of ballistic protection.

BACKGROUND

A satellite antenna for a mobile link has a piece of electronic equipment that is associated with a reception/transmission antenna that can be oriented toward the satellite. By way of example, the satellite antenna is positioned on the roof of an armored vehicle that is able to maneuver on a theater of battle.

FIG. 1 shows a satellite antenna 10, of electronic antenna type, from the prior art for mobile links. The satellite antenna 10 has an electronic module 12 that is associated with a transmission/reception panel 14 having a plurality of dipoles. The antenna, which is mounted on a rotating support 16 having an axis of rotation OZ perpendicular to a horizontal plane H, is oriented at 45° relative to said horizontal plane H. Its main lobe 18 of radiation may be oriented angularly in electronic fashion between the vertical axis OZ and a horizontal axis OX of a reference trihedron OXYZ. Control of the angular position of the lobe of the satellite antenna in the vertical plane and mechanical control in the horizontal plane allow the main lobe of the antenna to be oriented toward the satellite whatever the position of the vehicle.

The satellite antenna is protected from the ambient environment by a conventional radome 20 in the form of a dome having an axis of revolution OZ. The conventional radome 20 protects the satellite antenna from atmospheric elements such as rain, wind, humidity or from dust. This conventional radome has a low thickness in order to limit radio losses that adversely affect the performance of the antenna.

The satellite antenna 10 allows a combat vehicle to maintain contact while VHF radio means are out of range. It is therefore important to protect this link more effectively. Accordingly, it is necessary for the antenna equipped with its conventional radome to be able to resist, inter alia, impacts:

- from 7.62 mm caliber munitions from weapons of AK47 and Dragunov type,
- 5.5 mm caliber NATO munitions,
- munitions in an armor-piercing version,
- pieces of shrapnel of at least 80 g at a speed of 600 m/s.

The disadvantage of the conventional protective radome is that it does not have sufficient strength to protect the satellite antenna from such impacts. Usually it is possible to use metal armor plating to obtain protection from impacts, but this type of armor plating is incompatible with the passage of radio waves, which affects the performance of the satellite antenna to a considerable degree.

SUMMARY OF THE INVENTION

In order to overcome the disadvantages of satellite antennas that are protected by a conventional radome, the invention proposes a protective ballistic radome for a satellite antenna, said satellite antenna being able to turn about an axis of rotation OZ, characterized in that it has:

- a circular support in the form of a ring, having an axis of revolution RR', which is intended to coincide with the axis of rotation OZ of the satellite antenna, with the circular support having a lower base and an upper part in planes that are respectively parallel and perpendicular to the axis RR', an annular groove, having an axis of revolution that coincides with the axis RR', opening onto the upper part of the circular support,
- a set of n contiguous walls P1, P2, . . . Pi, . . . Pn having upper ends and lower ends in planes that are respectively parallel and perpendicular to the axis RR', i being the rank of the wall, n being a number greater than 1, with the n walls having their lower ends inserted into the annular groove of the circular support in order to form a ballistic wall in the form of a tube of circular section, having the same axis of revolution RR', about said satellite antenna.

Advantageously, the ballistic radome is closed, at the upper ends of the walls P1, P2, . . . , Pi, . . . Pn, by a circular cover in order to completely protect the satellite antenna.

In one embodiment of the ballistic radome, each of the walls P1, P2, . . . Pi, . . . Pn in the form of a tube wall portion has a stack of three layers, a central layer made of braided polyethylene threads that is sandwiched between two other layers made of polyurethane foam, an internal layer and an external layer.

In another embodiment, like the walls P1, P2, . . . , Pi, . . . Pn, the circular cover has a stack of three layers, a central layer made of polyethylene having braided threads, that is sandwiched between two other layers made of polyurethane foam.

In another embodiment, the dimensions of the internal layer and of the external layer made of polyurethane foam are determined in order to ensure frequency matching for the air/central layer interface.

In another embodiment, the central layer made of polyethylene is an ultra-high molecular weight polyethylene having a dielectric permittivity E=2.2, as is made under the commercial designation DYNEEMA or by the the commercial designation SPECTRA, the polyurethane foam of the internal and external walls has a permittivity Er=1.7, a density 400 kg/m$^3$ and a thickness 8 mm.

In another embodiment, the ballistic radome has four walls P1, P2, P3, P4, n being equal to 4, each of the walls being included in a tube portion of circular section having an axis of revolution RR' between two planes passing through said axis RR' forming an angle a of 360°/4 or 90°.

In another embodiment, the walls P1, P2, P3, P4 and the circular cover are made integral with the circular support by at least two straps made of polyethylene that are attached by their respective ends to the circular support on either side of the axis RR'.

In another embodiment, the ballistic radome is equipped with a protective tarpaulin covering it, made of polyethylene.

In another embodiment, the ballistic radome has a piece made of polyethylene that is inserted into the axis RR' between the circular cover and the tarpaulin in order to obtain a rounded shape for the upper part of the tarpaulin and thus to avoid stagnation of rainwater.

A main aim of the ballistic radome according to the invention is to obtain greater protection from impacts for a satellite antenna for mobile links while ensuring the same radio transparency.

Another aim is to make it a simple and rapid matter to repair the ballistic radome in the event of impact damaging its protective wall.

BREIF DESCRIPTION OF THE DRAWING

The invention will be better understood with the aid of an exemplary embodiment of a ballistic radome according to the invention with reference to the indexed figures, in which:

FIG. 1, which has already been described, shows a satellite antenna, of electronic antenna type, from the prior art for mobile links;

DETAILED DESCRIPTION

Figure 1:
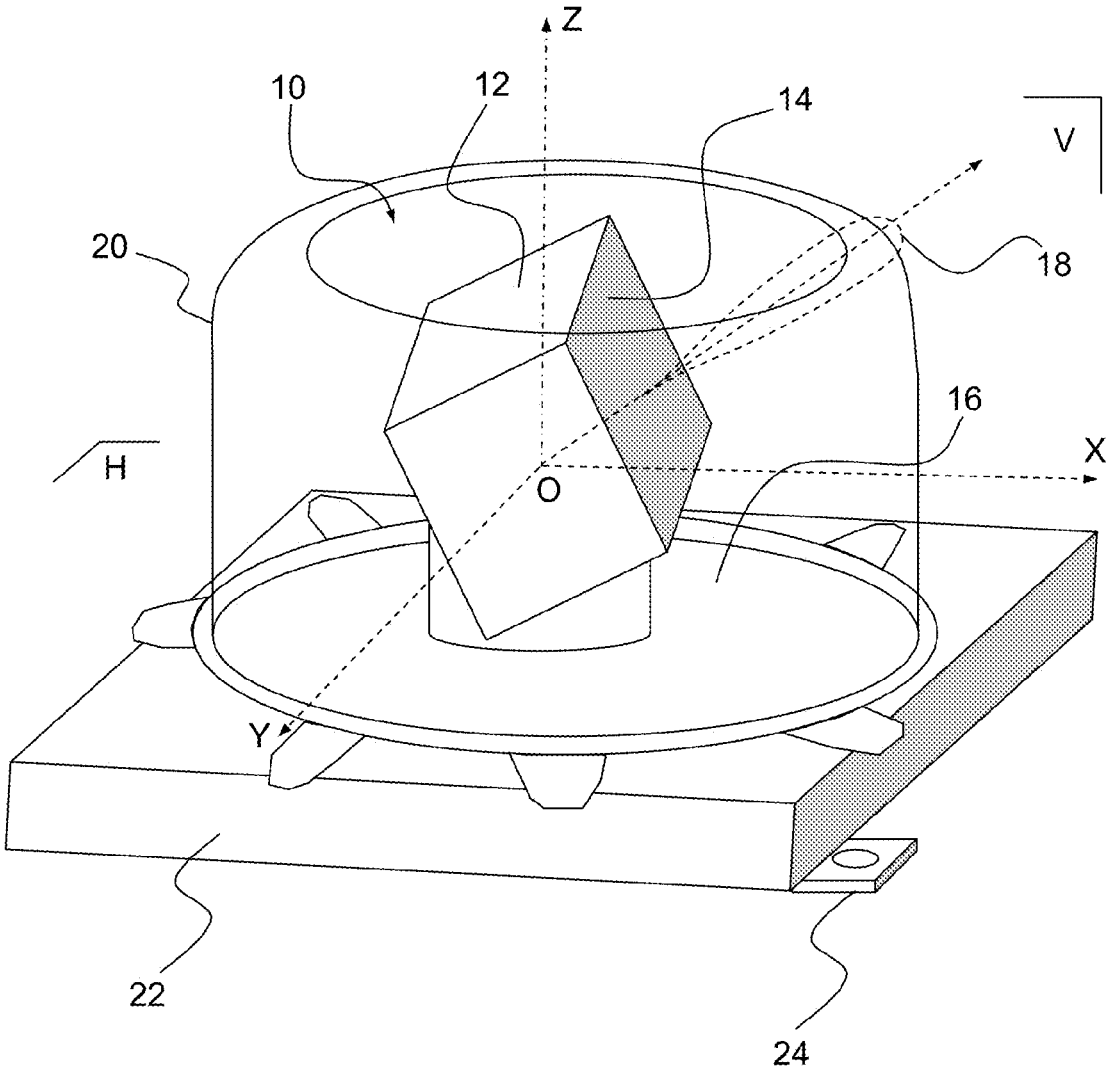
Figure 2:
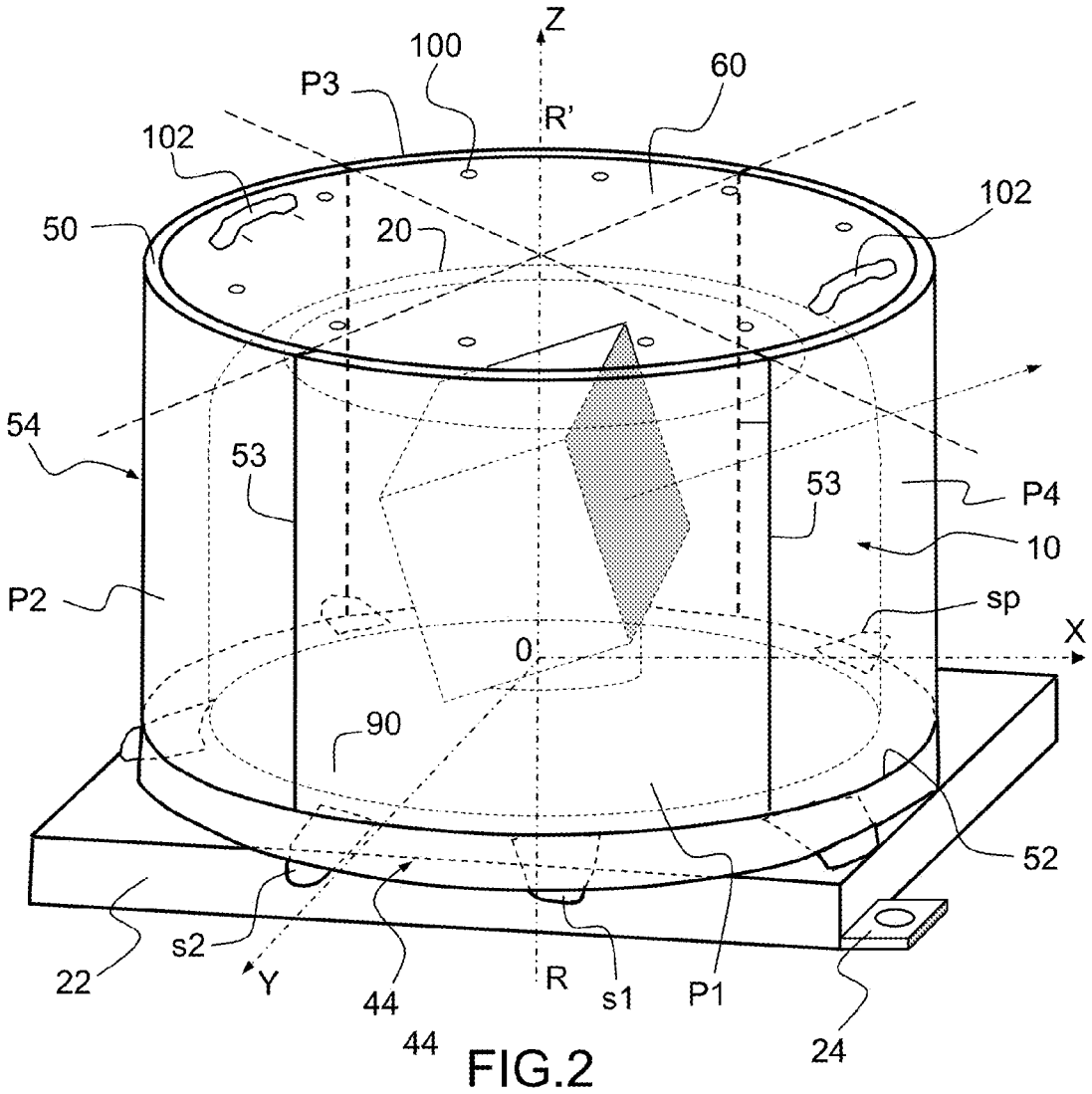
FIG. 2 shows an embodiment of a ballistic radome according to the invention for the satellite antenna of FIG. 1.

FIG. 2 shows an embodiment of a ballistic radome according to the invention for the satellite antenna of FIG. 1.

The satellite antenna as shown in FIG. 1, equipped with the conventional radome 20, is shown in dotted lines in FIG. 2, showing its position in a protective ballistic radome according to the invention.

The ballistic radome according to the invention has a circular support 44 in the form of a ring having an axis of revolution RR' that is intended to coincide with the axis of rotation OZ of the satellite antenna 10, and a set of four contiguous walls P1, P2, P3, P4 that are inscribed in a circular cylindrical surface having an axis of revolution that coincides with the axis RR'. The walls have upper ends 50 and lower ends 52 that are opposite in planes perpendicular to the axis RR', and edges 53 parallel to the axis RR'. The four walls are held in the circular cylindrical surface by the circular support 44 in order to form a ballistic wall 54 in the form of a tube of circular section.

The ballistic wall 54 is closed at the upper ends 50 of the walls P1, P2, P3, P4 by a cover 60 of circular shape.

Figure 3:
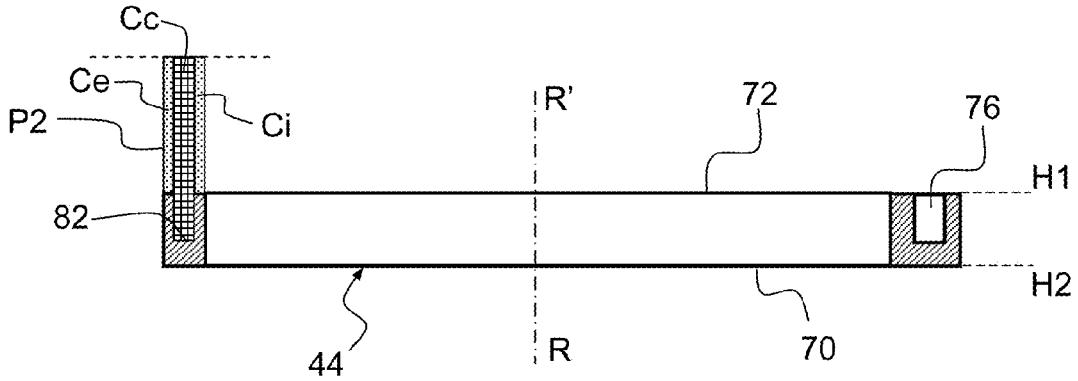
FIG. 3 shows a simplified sectional view of the circular support of the ballistic radome of FIG. 2.

FIG. 3 shows a simplified sectional view of the circular support of the ballistic radome of FIG. 2.

The circular support 44 in the form of a ring having an axis of revolution that coincides with the axis RR' has a lower base 70 and an upper part 72 in respective parallel planes H1, H2. The circular support 44 has an annular groove 76 opening onto the upper part 72 in order to insert the lower ends 52 of the contiguous walls P1, P2, P3, P4 of the ballistic radome.

Figure 4:
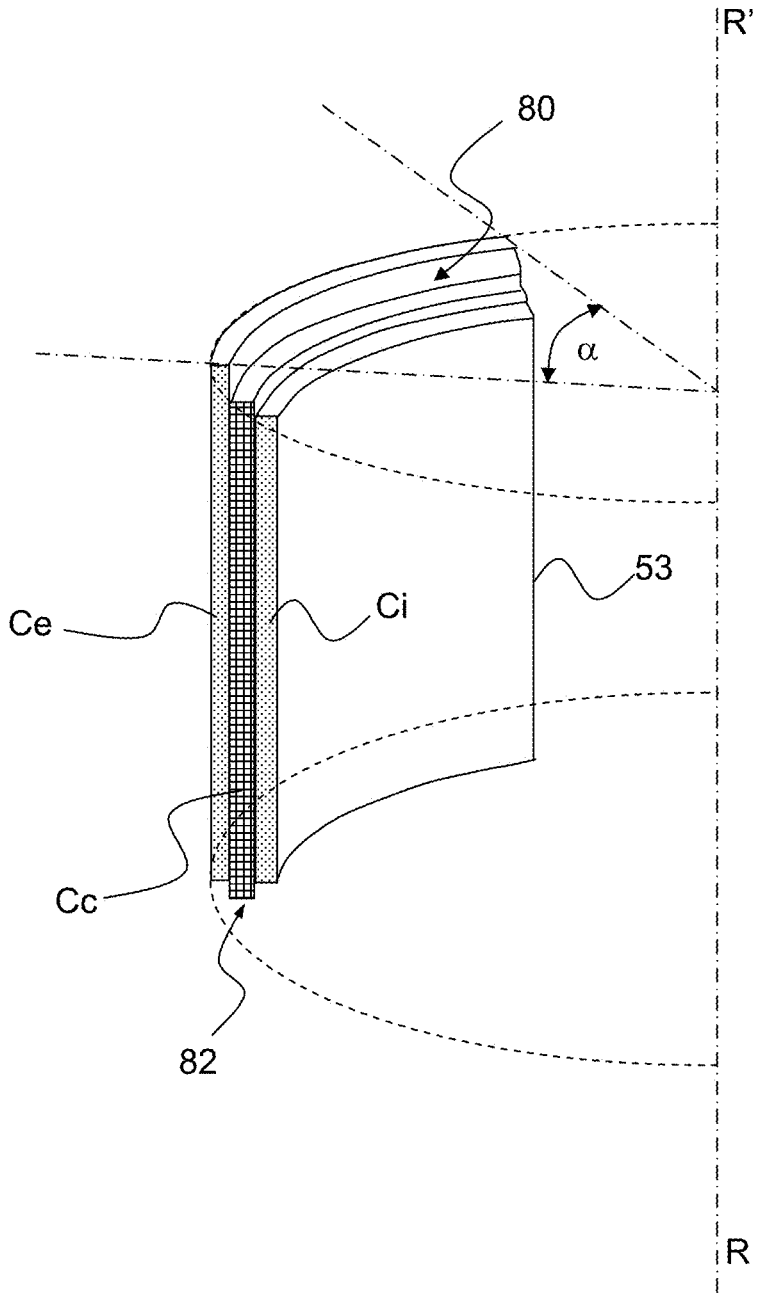
FIG. 4 shows a perspective view of a wall of the ballistic radome of FIG. 2.

FIG. 4 shows a perspective view of a wall of the ballistic radome of FIG. 2.

Each of the walls P1, P2, P3, P4 in the form of a tube wall portion has a stack of three layers, a central layer Cc embodied by braided polyethylene threads that is highly resistant to penetration, similar to the protective layer in bulletproof vests. The central layer is sandwiched between two other layers, an internal layer Ci and an external layer Ce made of high-density polyurethane foam.

The closing cover 60 has the same sandwich structure using the same materials as the walls P1, P2, P3, P4 but in circular shape.

The internal layer Ci and the external layer Ce made of polyurethane foam ensure frequency matching for the air/central layer Cc interface. The thickness of the internal Ci and external Ce layers is calculated and produced so as to obtain impedance matching for the wall 54 and for the circular cover 60 of the ballistic radome at the operating frequencies of the mobile link.

In this embodiment, the frequency of the signals that is received or emitted by the antenna is 8 GHz, the central layer Cc made of polyethylene that is an ultra-high molecular weight polyethylene having a dielectric permittivity E=2.2 that is produced, either under the commercial designation DYNEEMA or the commercial designation SPECTRA, and the polyurethane foam of the internal Ci and external Ce walls has a permittivity Er=1.7, a density 400 kg/m$^3$ and a thickness 8 mm.

The shape of the internal Ci and external Ce layers as a tube wall portion is obtained, on account of the high density of the foam, for example, by milling a block of polyurethane foam.

In each of the walls P1, P2, P3, P4, the external layer Ce is slightly shifted, along the axis RR', with respect to the internal Ci and central Cc layers in order to create a housing 80 at the upper ends 50 of the walls P1, P2, P3, P4 for the insertion of the closing cover 60 of the ballistic radome of FIG. 2. At the lower ends 52 of the walls, an edge 82 of the internal wall Ci juts out beyond edges of the internal Ci and external Ce walls. This edge 82 of the internal wall is intended to be inserted into the annular groove 76 in the circular support 44.

In this embodiment having four walls P1, P2, P3, P4, each of the walls is inscribed in a cylindrical surface portion between two planes passing through the axis RR' forming an angle a of 360°/4 or 90°.

The text below describes the steps for assembling the protective ballistic radome of the satellite antenna.

The ballistic radome is in the form of an assembly kit having essentially the circular support 60 in the form of a ring, the four walls P1, P2, P3, P4, the circular cover 60 and tightening straps for holding said elements of the kit.

A first phase consists in assembling the satellite antenna 10 shown in FIG. 1 on the roof of the mobile equipment, for example an armored vehicle. The satellite antenna 10 has a mechanical support 90 for a conventional radome 20 around the satellite antenna. The mechanical support 90 of the conventional radome 20 has a set of p mechanical supports s1, s2, . . . sp on its peripheral area that are intended to fix the circular support 60 of the ballistic radome according to the invention.

Figure 5:
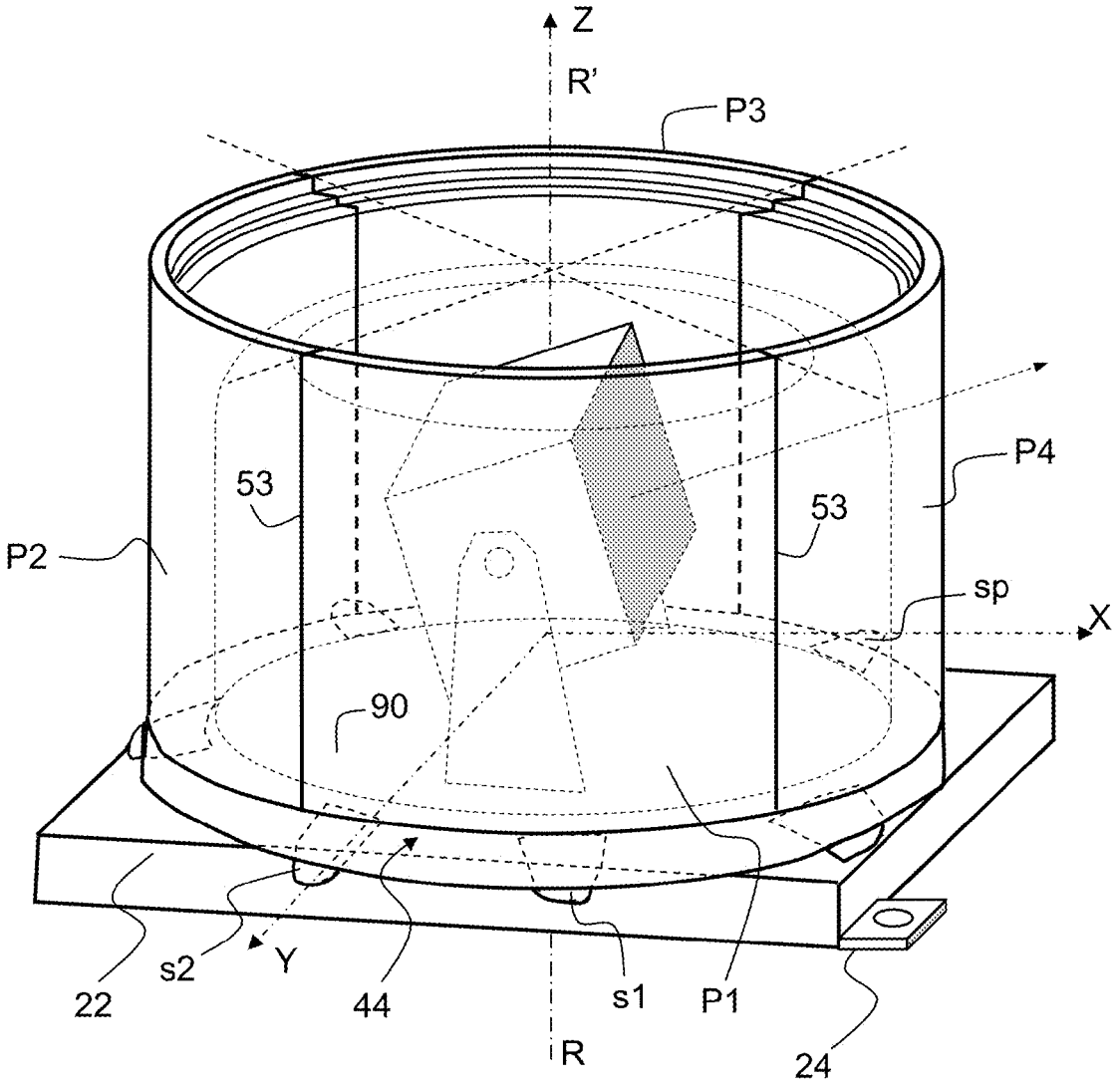
FIG. 5 shows an assembly step for the ballistic radome of FIG. 2.

A second phase involves the ballistic radome according to the invention being assembled. FIG. 5 shows a step in which the ballistic radome of FIG. 2 is assembled around the satellite antenna that has at least the following steps:

- in a first step: the circular support 44 is assembled on the p mechanical supports s1, s2, . . . sp of the mechanical support 90 of the conventional radome 20. This operation ensures that the ballistic radome is integral with the satellite antenna and that the axes RR' of the ballistic radome are aligned with that of the antenna OZ, which axes will coincide.
- in a second step: the walls P1, P2, P3, P4 are assembled by inserting, at the lower ends 52 thereof, the respective edge 82 of the central wall Ci into the annular groove 76 of the circular support 60. The walls P1, P2, P3, P4 are inserted into the annular groove 76 so that they are contiguous, in contact by means of their edges 53 that are parallel to the axis RR', forming the protective wall 54 in the form of a tube around the conventional radome 20. FIG. 3 shows particularly a partial sectional view of one of the walls P2 that has been inserted, at the lower end 52 thereof, by the edge 82 of the central wall Ci into the annular groove 76 of the circular support 44.

in a third step: the ballistic radome is closed by the circular cover 60 being inserted into the circular housings 80 at the upper ends 50 of the walls P1, P2, P3, P4. FIG. 2 shows the ballistic radome at the end of this third step.

The cover 60 is simply fitted into the housings 80 so as to allow the material of the walls P1, P2, P3, P4 to deform without constraints in the event of an impact.

The cover 60 has holes 100 that serve to drain stagnant water and two handles 102 made of nylon in proximity to the edge of the cover 60 in order to facilitate dismantling thereof.

The four walls P1, P2, P3, P4 and the cover 60 are made integral with the circular support 44 by two perpendicular straps g1, g2 made of polyethylene that are attached by their respective ends to the circular support 60 on either side of the axis RR'. The calculations and simulations show that this type of fixing of the walls and of the cover is more solid than fixing by rigid mechanical pieces such as angle irons and epoxy screws that explode in the event of an impact, and moreover the radio-frequency losses caused by this type of fixing are negligible.

Figure 6:
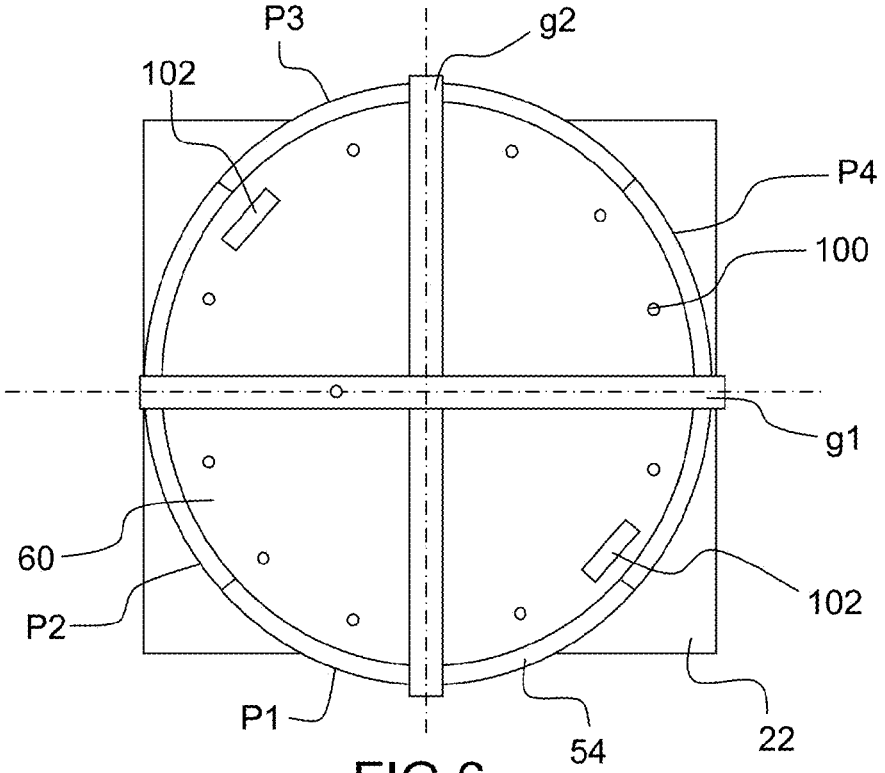
FIG. 6 shows a simplified top view of the radome of FIG. 2 having two tightening straps.

FIG. 6 shows a simplified top view of the radome of FIG. 2 having two tightening straps.

The ballistic radome can be equipped with a polyethylene tarpaulin 90 for protection from the rain and also to provide it with camouflage. The radio-frequency losses from the polyethylene tarpaulin are also minimal.

A piece 92, also made of polyethylene, can be inserted into the axis RR' between the cover 60 and the tarpaulin 90 in order to obtain a rounded shape for the upper part of the tarpaulin and thus to avoid stagnation of rainwater.

Figure 7:
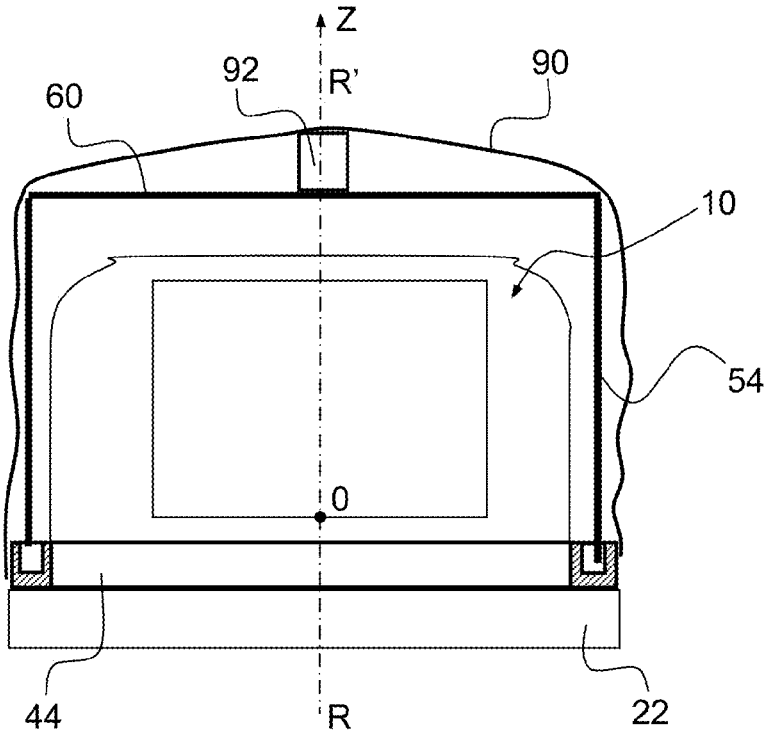
FIG. 7 shows a simplified sectional drawing of the ballistic radome of FIG. 2 protected by a tarpaulin.

FIG. 7 shows a simplified sectional drawing of the ballistic radome of FIG. 2 protected by a tarpaulin.

The main advantages of the ballistic radome according to the invention are its very high resistance to impact and its high level of radio transparency on account of the fact that no epoxy material is used for producing the walls, cover and fixings, which allows the radio-frequency performance of the satellite antenna protected in this manner to be maintained.

Another advantage is the ease of repairing the ballistic radome. In the event of an impact destroying one or more walls, these can be replaced very quickly by simply removing the tightening straps then replacing the damaged wall or walls by simply inserting new walls into the groove in the circular support of the radome. The conventional radome for the antenna, which is still in place, allows the antenna to be protected from any debris owing to impacts on the walls of the ballistic radome.

The invention claimed is:

1. A protective ballistic radome for a satellite antenna, said satellite antenna being able to turn about an axis of rotation OZ, comprising:

a circular support in the form of a ring, having an axis of revolution RR', which is intended to coincide with the axis of rotation OZ of the satellite antenna, with the circular support having a lower base and an upper part in planes that are respectively parallel and perpendicular to the axis RR', an annular groove, having an axis of revolution that coincides with the axis RR', opening onto the upper part of the circular support, a set of n contiguous walls P1, P2, . . . Pi, . . . Pn having upper ends and lower ends in planes that are respectively parallel and perpendicular to the axis RR', i being the rank of the wall, n being a number greater than 1, with the n walls having their lower ends inserted into the annular groove of the circular support in order to form a ballistic wall in the form of a tube of circular section, having the same axis of revolution RR', about said satellite antenna, wherein each of the walls P1, P2, . . . Pi, . . . Pn in the form of a tube wall portion has a stack of three layers, a central layer made of braided polyethylene threads that is sandwiched between two other layers, an internal layer and an external layer, each made of polyurethane foam, wherein the central layer is made of ultrahigh molecular weight polyethylene, and wherein the dimensions of the internal layer and of the external layer made of polyurethane foam are determined in order to ensure frequency matching for the air/central layer interface.

2. The radome as claimed in claim 1, wherein it is closed, at the upper ends of the walls P1, P2, . . . , Pi, . . . Pn, by a circular cover in order to completely protect the satellite antenna, wherein the circular cover has a stack of three layers, a central layer made of polyethylene having braided threads, that is sandwiched between two other layers made of polyurethane foam, wherein the central layer of the cover is made of ultrahigh molecular weight polyethylene.

3. The radome as claimed in claim 1, wherein the central layer made of polyethylene has a dielectric permittivity E=2.2, and the polyurethane foam of the internal and external walls has a permittivity Er=1.7, a density 400 kg/m$^3$ and a thickness 8 mm.

4. The radome as claimed in claim 1, wherein it has four walls P1, P2, P3, P4, n being equal to 4, each of the walls being included in a tube portion of circular section having an axis of revolution RR' between two planes passing through said axis RR' forming an angle a of 360°/4 or 90°.

5. The radome as claimed in claim 4, wherein the walls P1, P2, P3, P4 and the circular cover are made integral with the circular support by at least two straps made of polyethylene that are attached by their respective ends to the circular support on either side of the axis RR'.

6. The radome as claimed in claim 1, equipped with a protective tarpaulin covering the radome, made of polyethylene.

7. The radome as claimed in claim 6, further comprising a piece made of polyethylene that is inserted into the axis RR' between the circular cover and the tarpaulin in order to obtain a rounded shape for the upper part of the tarpaulin and thus to avoid stagnation of rainwater.

* * * * *